US005287152A

United States Patent [19]

Oka et al.

[11] Patent Number: 5,287,152

[45] Date of Patent: Feb. 15, 1994

[54] ELECTRIC CHARGE SUPPLYING DEVICE AND SYSTEM EMPLOYING THE SAME

[75] Inventors: Tateki Oka, Atsugi; Kazuyoshi Hara, Isehara; Koji Uno, Kawasaki; Hitoshi Saito; Yasuo Tanaka, both of Machida, all of Japan

[73] Assignee: Minolta Camera Kabushiki Kaisha, Osaka, Japan

[21] Appl. No.: 990,503

[22] Filed: Dec. 15, 1992

[51] Int. Cl.[5] ..... G03G 15/14

[52] U.S. Cl. ..... 355/274; 355/219; 355/271; 361/225

[58] Field of Search ..... 355/219, 271, 273, 274, 355/277, 208; 361/225

[56] References Cited

U.S. PATENT DOCUMENTS

| | | | |
|---|---|---|---|
| 4,401,383 | 8/1983 | Suzuki et al. | 355/273 X |
| 4,415,254 | 11/1983 | Nishikawa | 355/274 |
| 4,699,499 | 10/1987 | Hoshika et al. | 355/274 |
| 5,119,141 | 6/1992 | Bhagat | 355/274 |
| 5,150,165 | 9/1992 | Asai | 355/274 |
| 5,172,173 | 12/1992 | Goto et al. | 355/274 X |

FOREIGN PATENT DOCUMENTS

| | | |
|---|---|---|
| 0367245A2 | 5/1990 | European Pat. Off. . |
| 56-35159 | 4/1981 | Japan . |
| 56-113176 | 9/1981 | Japan . |
| 2-120778 | 5/1990 | Japan . |

*Primary Examiner*—A. T. Grimley
*Assistant Examiner*—Sandra L. Brasé
*Attorney, Agent, or Firm*—Willian Brinks Hofer Gilson & Lione

[57] ABSTRACT

An electric charge supplying device for supplying electric charges to a body to be charged, comprises a charge-supplying member arranged in contact with the body to be charged, a power supply for supplying electricity to the charge-supplying member, and a shunt resistance connected in parallel with a series circuit including the charge supplying member and the body to be charged, the shunt resistance having environmental dependency of resistance substantially equal to that of the charge supplying member.

34 Claims, 14 Drawing Sheets

ELECTRIC CHARGE SUPPLYING DEVICE AND SYSTEM EMPLOYING THE SAME

BACKGROUND OF THE INVENTION

1. Field of the Invention

The present invention relates to an electric charge supplying device used as an charging device for sensitizing a photoconductive member or as an image transfer device for transferring powder images on the photoconductive member to a transfer material such as transfer paper.

2. Description of the Prior Art

In electrophotographic image reproduction systems such as electrophotographic copiers, printers and facsimiles, powder images, developed on a photoconductive member, are transferred to a transfer material such as transfer paper by charging the transfer material with an electric charge supplying device. Also, the photoconductive member is charged by an electrical charging device to sensitize it.

To this end, so far, various charging devices have been used in the image transfer devices. For example, there has been used an electrostatic transfer device comprising a conductive transfer roller of a foamed material that is arranged parallel to a photoconductive drum and brought into contact therewith, and a high-voltage power supply connected to a metal core or shaft of the transfer roller.

In such a device, a sheet of transfer paper is fed to a contacting portion between the photoconductive drum and the transfer roller simultaneously with rotation of the photoconductive drum, and powder images, developed on a photoconductive surface of the drum with a dry developer and composed of charged toners, are transferred to the transfer paper by supplying electric charges with the polarity opposite to that of the charged toners to the transfer paper through the transfer roller serving as a charge supplying member.

However, electrical resistance of the transfer roller and that of the transfer paper are varied approximately two orders of magnitude by changes of environmental conditions such as a temperature and humidity. For example, if the environmental conditions of the transfer device is changed from conditions of normal temperature and normal humidity (hereinafter referred to as "N/N conditions") to conditions of a low temperature and a low humidity (hereinafter referred to as "L/L conditions"), the resistance of the transfer roller is increased several orders of magnitude. In contrast therewith, the resistance of the roller is reduced one or two orders of magnitude under the environmental conditions of a high temperature and a high humidity (hereinafter referred to as "H/H conditions"), compared with that under the N/N conditions.

Accordingly, if the power supply is of a constant-voltage control system designed to keep its output voltage constant, the transfer roller does not provide a sufficient current for the transfer of charged toners under the L/L conditions, resulting in failure in image transfer. Further, under the H/H conditions, the photoconductive drum provides transfer memories during quiescent time of paper feeding, resulting in the printed image with much fogging in the background area thereof.

On the other hand, if the power supply is of a constant-current control system designed to keep its output current applied to the roller constant, an electric current flowing through an area of the roller where the transfer roller is in direct contact with the photoconductive drum increases when the transfer paper fed between the drum and roller is small in size. Thus, an electric current, which flows through an area of the roller where the roller is in contact with the transfer paper, becomes too small to transfer the charged toners from the drum to the transfer paper, resulting in failure in the image transfer.

To solve such problems, it has been proposed in EP-A-0 367 245 to use a power control system (i.e., an active transfer voltage control system, hereinafter referred to as an "ATVC system") which performs the constant-current control of an electric power to be applied to the roller during quiescent time of paper feeding, but performs a constant-voltage control during paper feeding on the basis of the voltage applied to the roller during the constant-current control.

It is, however, essential for the above ATVC system to provide feedback circuits to maintain the output voltage and current constant. Thus, the image transfer device becomes complex in control.

SUMMARY OF THE INVENTION

It is therefore an object of the present invention to provide an electric charge supplying device capable of maintaining an electric current flowing through a charge-supplying member constant regardless of changes of environmental conditions.

Another object of the present invention is to provide a charging device capable of maintaining an electric current flowing through a charge supplying member constant regardless of changes of environmental conditions.

Still another object of the present invention is to provide an image transfer device capable of maintaining an electric current flowing through a photoconductive member or an image carrier constant regardless of variation in resistance of a charge supplying member caused by changes of environmental conditions.

The above and other objects of the present invention are achieved by providing a shunt resistance connected in parallel with a series circuit including a charge supplying member and a member to be charged, the shunt resistance having environmental dependency of resistance equal to that of the charge supplying member.

According to the present invention, there is provided an electric charge-supplying device for supplying electric charge to a member to be charged, said device comprising: a charge-supplying member adapted to be brought into contact with said member to be charged; a constant-voltage power supply for producing a predetermined constant voltage; a first resistance electrically inserted between said power supply and said charge-supplying member; and, a second resistance electrically connected in series with said first resistance but in parallel with a circuit of a current flowing from said charge-supplying member to said body to be charged, said second resistance having environmental dependency of resistance equal to that of the charge-supplying member.

The above second resistance serving as a shunt resistance may be constituted by a part of the rubber layer of the transfer roller, or by a resisting material having the same environmental dependency of resistance as that of the rubber layer of the transfer roller. In the latter case, the resisting material may be formed into a conductive layer bonded to a shaft or a ring, or into bristles held by one electrode. In the former, one of terminals or electrodes of the second resistance is constituted by the shaft of the image transfer roller. However, the other terminal or electrode may be constituted by providing a conductive cylindrical member on a part of the rubber layer, or by forming a conductive layer on the surface of the member to be charged. The conductive cylindrical member may be a ring fitted on one or both ends of the transfer roller. In such a case, it is preferred to provide a plurality of perforations or projections which allow the rubber layer to be exposed to the air. Further, the transfer roller may be provided at its either end with a small-sized rubber portion having a diameter smaller than that of the remaining rubber portion of the transfer roller, i.e., an effective rubber layer adapted to be brought into contact with the surface of the member to be charged, and the conductive cylindrical member is fitted on the small-sized rubber portion.

In the charge supplying device of the present invention, the shunt resistance has the environmental dependency of resistance approximately equal to that of the charge-supplying member and is connected in parallel with a series circuit including the charge-supplying member and the member to be charged, so that a current flowing in the charge-supplying member is regulated to a value approximately equal to that of the current which flows in the charge-supplying member when the image transfer device is operated under the conditions of normal temperature and humidity.

These and other objects, features and advantages of the present invention will become apparent from the following description taken in conjunction with the preferred embodiments thereof with reference to the accompanying drawings in which like parts are designated by like reference numerals throughout the drawings.

DETAILED DESCRIPTION OF THE PREFERRED EMBODIMENTS

Figure 1:
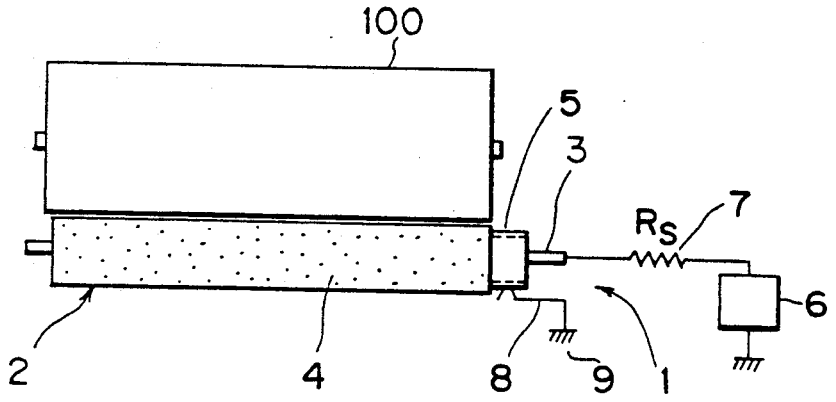
FIG. 1 is a schematic diagram of an image transfer device embodying the present invention.

Referring now to FIG. 1, there is shown an embodiment of an image transfer device according to the present invention. The image transfer device, generally indicated by 1, comprises an image transfer roller 2 including a conductive core or shaft 3 and a foamed spongelike rubber layer 4 integrally formed thereon. The rubber layer 4 is generally composed of silicone rubber and carbon black dispersed therein so as to have an electric resistance of $10^6$ to $10^9$ Ωcm.

The transfer roller 2 is arranged parallel to a photoconductive member or drum 100 serving as an image carrier, and pushed against the drum 100 by a light force, for example, of 600 g so that it rotates with rotation of the drum 100. The image transfer device 1 includes a high voltage power supply 6 with constant-voltage characteristics such as a high voltage transformer, which is electrically connected at its one terminal to the shaft 3 of the transfer roller 2 through a control resistor 7 and at the opposite terminal to the electrical ground 9.

Figure 2:
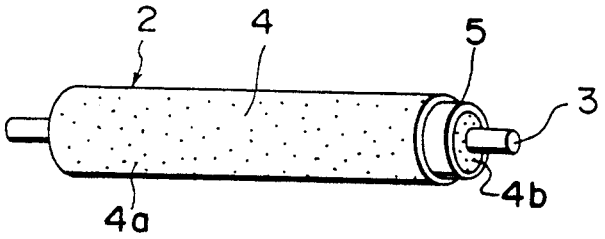
FIG. 2 is a perspective view of an image transfer roller used in the image transfer device of FIG. 1.

As best shown in FIG. 2, the rubber layer 4 of the transfer roller 2 is reduced in diameter at one end thereof to form a small-sized rubber layer 4*b* extending in an axial direction of the shaft 3. Fitted on the small-sized rubber layer 4*b* is a ring 5 which is electrically connected to the electrical ground 9 through an electrode 8. Thus, the small-sized rubber layer 4*b* serves as a resisting material and constitutes a shunt resistance together with the ring 5 and the shaft 3.

A main part of the rubber layer 4 extending along the entire length of the drum 100 serves as an effective rubber layer 4*a* and is brought into contact with an image-forming area of the drum 100 to transfer powder images, developed on an image-forming area of the drum, to a transfer material such as transfer paper.

The ring 5, which serves as an earthing electrode for the shunt resistance, is made of a metal such as, for example, aluminum and phosphorus bronze, or a conductive plastic. Typical conductive plastic includes, without being limited to, organic conducting polymers such as, for example, polyacetylene, polypyrroles and polythienylene, and those comprising a non-conductive synthetic resin and a conductive material dispersed therein. As a nonconductive synthetic resin, there may be used those such as polypropylene, nylon and the like. As a conductive material, there may be used those such as, for example, metal powders, metal fibers, graphite fibers and the like.

Figure 3:
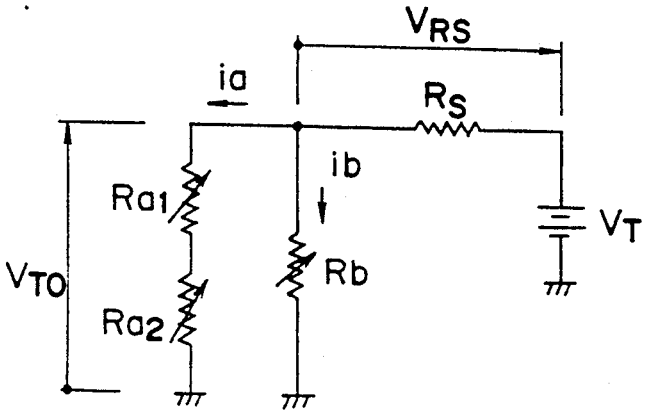
FIG. 3 is an equivalent circuit for the image transfer device of FIG. 1.

The equivalent circuit for the image transfer device is shown in FIG. 3, in which $V_T$ is an output voltage of the power supply 6, $R_s$ is resistance of the control resistor 7 serving as a first resistance, $R_{a1}$ is a value of resistance of the rubber layer 4*a* between the shaft 3 and the photoconductive surface of the drum 100, $R_{a2}$ is equivalent resistance of the paper sheet and/or an photoconductive layer of the drum 100, $R_b$ is the shunt resistance, i.e., a resistance of the shunt circuit including the rubber layer 4*b* between the shaft 3 and the earthing ring 5, $i_a$ is a current flowing into the drum 100 through the rubber layer 4*a*, $i_b$ is a current flowing through the shunt circuit including the rubber layer 4*b* and the ring 5, $V_{rs}$ is a drop voltage caused by the resistance $R_s$ of the resistor 7, $V_{TO}$ is a drop voltage caused by the resistance $R_{a1}$ and $R_{a2}$ or by the shunt resistance $R_b$. Also, $R_{a1}$, $R_{a2}$ and $R_b$ are illustrated as being variable resistances since values of the resistance of the rubber layer 4*a*, transfer paper, and the rubber layer 4*b* vary with the environmental conditions of the image transfer device 1.

Figure 5:
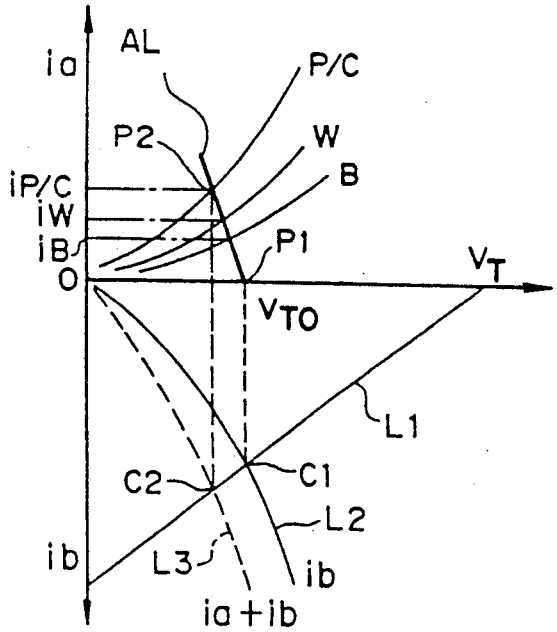
FIG. 5 is a diagram showing voltage versus current characteristics of the image transfer device of FIG. 1 operated under the H/H conditions.
Figure 6:
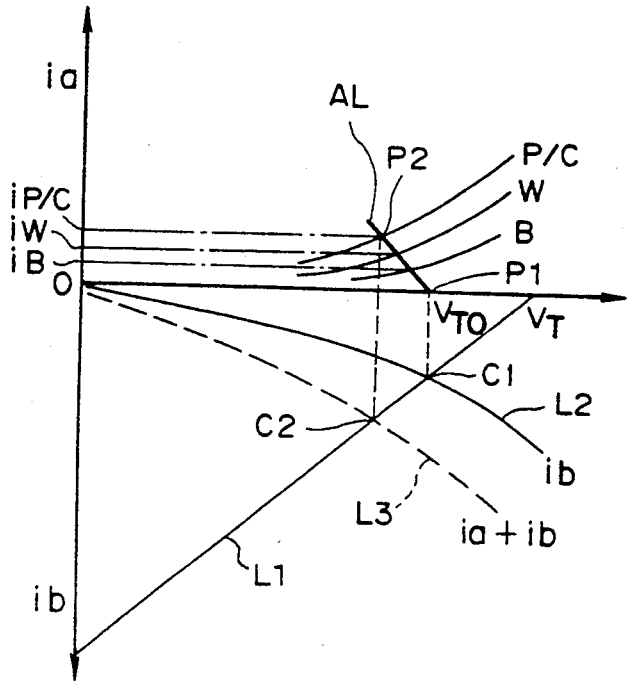
FIG. 6 is a diagram showing voltage versus current characteristics of the image transfer device of FIG. 1 operated under the L/L conditions.

The operating characteristic of the above image transfer device 1 will be explained below, making reference to FIG. 4 to FIG. 6. In these figures, a coordinate axis extending upwardly from the origin O is used to express the current $i_a$, while a coordinate axis extending downward from the origin is used to express the current $i_b$ flowing through the shunt circuit.

In the fourth quadrant, $L_1$ shows an operating curve determined by the control resistance $R_s$, $L_2$ shows a voltage dependency of the current $i_b$ that flows through the ring 5 on the basis of the assumption that $i_a=0$, $L_3$ is a voltage dependency of total current, $i_a+i_b$, given by taking into account of a voltage dependency of $i_a$.

In the first quadrant, P/C is a characteristic curve for the current flowing through the photoconductive drum 100, W is a characteristic curve for the current flowing through a white portion of the images, i.e., an area of the paper sheet that is in contact with the image-forming area of the photoconductive drum 100 with no powder or toner images, B is a characteristic curve for the current flowing through a black portion of the images, i.e., an area of the paper sheet that is in contact with the toner images developed on the image-forming area of the photoconductive drum 100. In the above case, a value on the characteristic curve for P/C equals to a difference between values on the characteristic curves $L_1$ and $L_2$.

Figure 4:
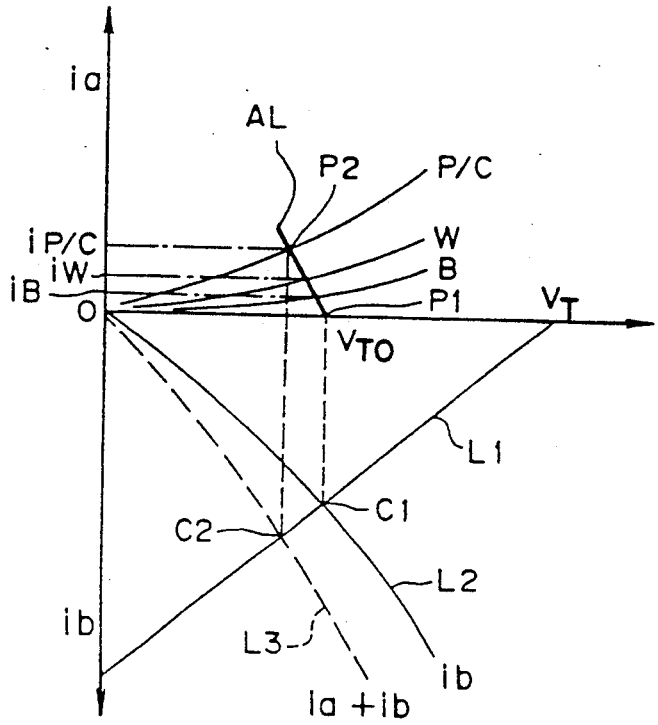
FIG. 4 is a diagram showing voltage versus current characteristics of the image transfer device of FIG. 1 operated under the N/N conditions.

Referring now to FIG. 4 which shows characteristic curves under the N/N conditions, the drop voltage $V_{TO}$, caused by the series circuit of the resistance $R_{a1}$ and $R_{a2}$ or by the shunt resistance $R_b$, is determined by a value of voltage at point $P_1$ on the abscissa that corresponds to the horizontal coordinate of point $C_1$ where the operating curve $L_1$ and the characteristic curve $L_2$ intersect. The current, $i_{p/c}$, that flows in the photoconductive drum 100, is determined by a value of current at point $P_2$ on the characteristic curve P/C, that corresponds to the vertical coordinate of point $C_2$ where the operating curve $L_1$ and the characteristic curve $L_3$ intersect.

Similarly, the currents, $i_W$ and $i_B$, each of which flows through the white portion of the images or through the black portion of the images, are respectively determined by a value of current at a point where the characteristic curve W or B intersects with the operating curve AL connecting the points $P_1$ and $P_2$. Although the operating curve AL does not show ideal constant-voltage characteristic, it can be regarded as being approximate constant-voltage characteristics.

In the practical image transfer device, therefore, the currents, $i_{P/C}$, $i_W$ and $i_B$ can be determined to any desired values by proper determination of the output voltage $V_T$ of the power supply 6, the resistance Rs and sizes of the ring 5.

If the environmental conditions have changed from the N/N conditions to the H/H conditions, the resistance of rubber layer 4 is lowered in response to the change of environmental conditions. Thus, the currents $i_a$ and $i_b$ are increased as shown in FIG. 5. At the same time, the current characteristics curve L2 shifts to the higher current side (lower side in the figure). On the other hand, the characteristic curves P/C, W and B are shift to the lower voltage side (the left side in the figure) and the higher current side (the upper side in the figure). Thus, the voltage dependency of $i_{P/C}$, $i_W$ and $i_B$ becomes large because of decrease in resistance of the rubber layer 4.

Since the drop voltage $V_{TO}$ lowers with increase of the voltage dependency of characteristic curves P/C, W and B and since the gradient of the operating curve AL becomes sharp, the currents $i_{P/C}$, $i_W$ and $i_B$, given by points where the operating curve AL intersects with the respective characteristic curves P/C, W and B, are set to values approximately equal to those determined under the N/N conditions.

On the other hand, if the environmental conditions have changed from the N/N conditions to the L/L conditions, the resistance of rubber layer 4 increases. This results in decrease in both the current $i_a$ flowing through the resistance $Ra_1$ and the current $i_b$ flowing through the shunt resistance $R_b$. Thus, the current characteristics curve L2 for $i_b$ shifts toward the lower current side (i.e., the upper side in the figure), as shown in FIG. 6. At the same time, the characteristic curves P/C, W and B shift to the higher voltage side (i.e., the right side in the figure) and to the lower current side (i.e., the lower side in the figure) because of increase of the resistance of the rubber layer 4. Thus, the voltage dependency of characteristic curves P/C, W and B decreases so that the drop voltage $V_{TO}$ increases and the gradient of the operating curve AL becomes blunt. For these reasons, $i_{P/C}$, $i_W$ and $i_B$ are set to values approximately equal to those determined under the N/N conditions.

As will be understood from the above, if the resistance of the rubber layer 4a varies with changes of the environmental conditions as well as that of the transfer paper, the voltage applied to the rubber layer 4a is automatically controlled in response to the changes of the environmental conditions. Thus, the transfer current of the photoconductive drum 100 and the paper sheet is automatically controlled to a value within the predetermined ranges.

Figure 7:
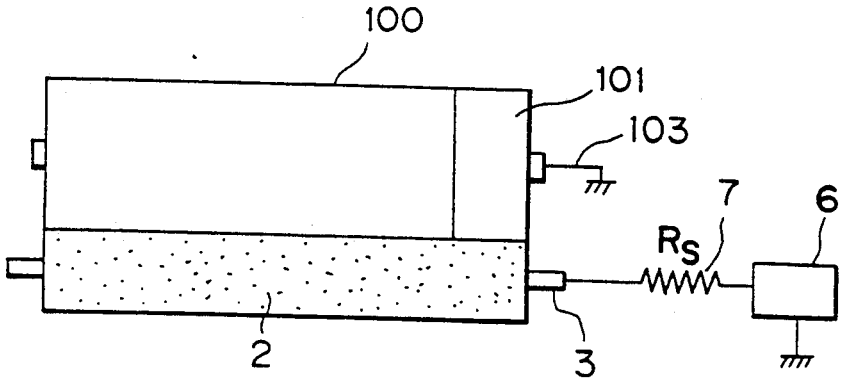
FIG. 7 is a schematic diagram of an image transfer device illustrating another embodiment of the present invention.

In the above embodiment, the shunt resistance $R_b$ is constituted by fitting the ring 5 on the rubber layer 4b and connecting it to the electrical ground 9. However, the shunt resistance $R_b$ may be constituted by providing a conductive surface 101 on one end of the photoconductive drum 100 in an area out of an image forming area of the drum, and connecting it to an earthing electrode 103 of the photoconductive drum 100, as shown in FIG. 7.

In this case, the photoconductive drum 100 per se serves as the earthing electrode. Thus, there is no need to provide a separate earthing member or electrode around the transfer roller 2, making it possible to simplify the structure of the image transfer device.

Figure 8:
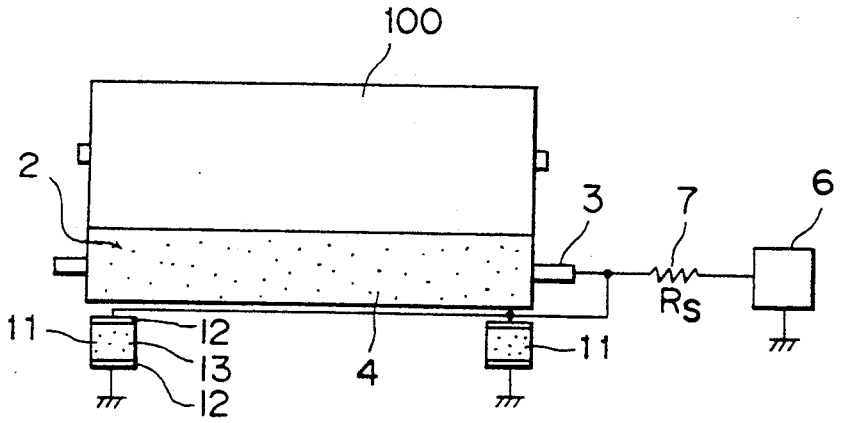
FIG. 8 is a schematic diagram of an image transfer device illustrating still another embodiment of the present invention.

Further, the shunt resistance $R_b$ may be constituted by providing a resistance block 11 on either side of the transfer roller 2, as shown in FIG. 8. In this embodiment, each resistance block consists of a resisting material 13 sandwiched between a pair of electrodes 12, one of which is electrically connected to the shaft 3 of the transfer roller 2, while the other electrode being grounded. The resisting material 13 is composed of the identical material with that used for the rubber layer 4 of the transfer roller 2.

Since the resistance blocks 11 do not require a large space and are free for attachment, they can be arranged in any desired places. Further, since the resistance block 11 can be held in a fixed position, different from the resistance to be fitted on the transfer roller 2 or the drum 100, it is possible to solve problems caused by rotation or sliding motion of the transfer roller 2 or the drum 100.

Figure 9:
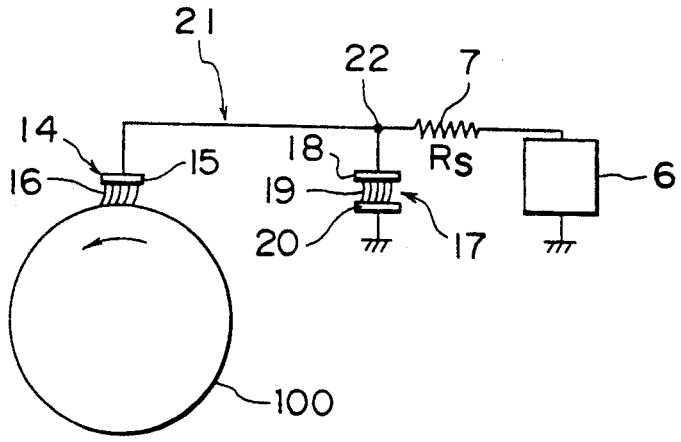
FIG. 9 is a schematic diagram of a charging device embodying the present invention.

In the foregoing embodiments, the charge supplying device of the present invention is applied to the image transfer device, but it may be applied to a charging device for electrophotographic image reproduction devices, as shown in FIG. 9.

The charging device 21 comprises a charging brush 14 consisting of an electrode 15 and a bundle of bristles 16 fixed thereto at one end. The charging brush 14 is arranged along the entire length of a photoconductive drum 100 so that free ends of the bristles 16 come in contact with an image-forming surface of the photoconductive drum 100. The charging device 21 further includes a control resistor 7 and an additional brush 17 consisting of an electrode 18 and a bundle of bristles 19 fixed thereto at one end. Spaced from the electrode 18 is an earthing electrode 20 which is electrically connected to the electrical ground 9 and brought into contact with free ends of the bristles 19. The bristles 19 of the additional brush 17 are composed of the same material as that of the bristles 16 so that the brush 17 has the environmental dependency of resistance substantially equal to that of the bristle 14. The additional brush 17 is electrically connected in parallel with the charging brush 14 but in series with the control resistor 7 at a connecting point 22 to constitute a shunt circuit serving as reference resistance or shunt resistance.

In this charging device, the charging potential of the brush 14 with respect to the drum 100 is automatically controlled to a value within a predetermined range even if the resistance of bristles 16 varies with changes of the environmental conditions as the shunt circuit with the same environmental dependency of resistance as that of charging brush 14 is connected in parallel therewith.

In the foregoing embodiments, the material for the rubber layer 4 or bristles 16 is used as a material for shunt resistance, but any other materials may be used as a material for shunt resistance, provided that they possess the same properties against the environmental conditions such as temperature and humidity, i.e., the same environmental dependency of resistance, that the material for the transfer roller 2 possesses.

Figure 10:
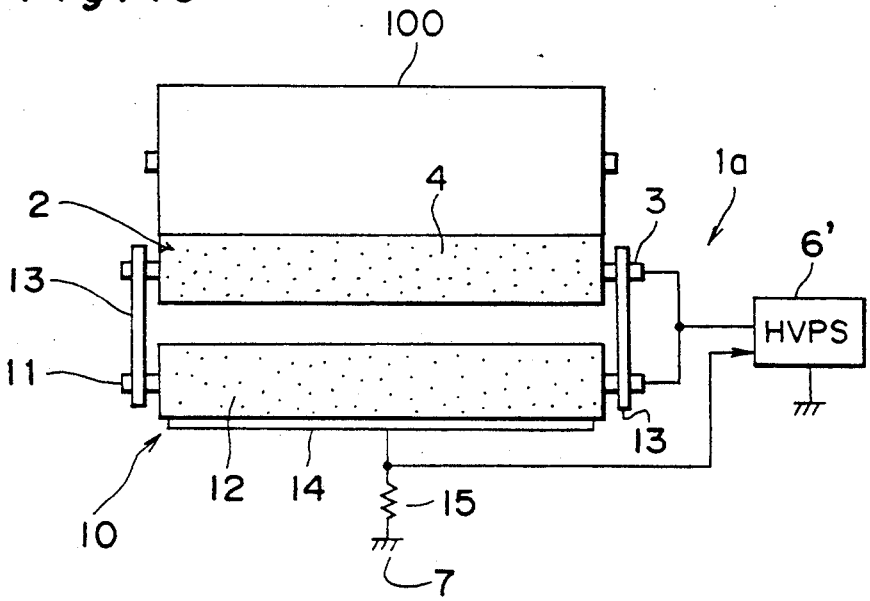
FIG. 10 is a schematic diagram of an image transfer device illustrating another embodiment of the present invention.

Referring now to FIG. 10, there is shown another embodiment of an image transfer device according to the present invention. In this embodiment, the transfer device 1 includes a roller assembly comprising an image transfer roller 2 and an additional roller 10 constituting a shunt resistance. The additional roller 10 is identical in shape, size and materials with those of the transfer roller 2 and includes a conductive shaft 11 and a rubber layer 12 integrally formed thereon.

Figure 11:
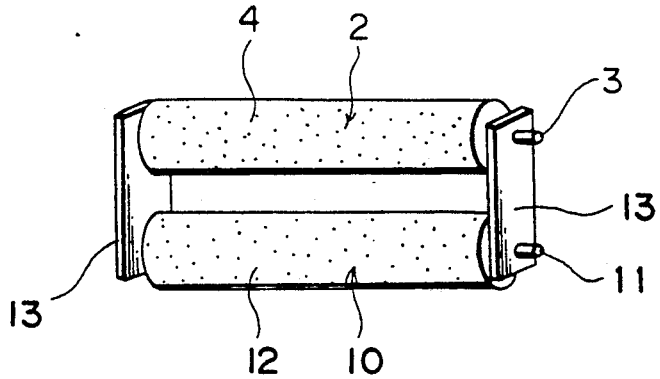
FIG. 11 is a perspective view of a roller assembly used in the image transfer device of FIG. 10.

As best shown in FIG. 11, the additional roller 10 is arranged parallel to the transfer roller 2 and its shaft 11 is coupled to the shaft 3 by a pair of an insulating connecting members 13. The roller shaft 11 is electrically connected to a high voltage power supply 6' with a constant-current characteristic, as well as that of the transfer roller 2, while the rubber layer 12 is connected the electrical ground 9 through an electrode plate 14 and the resistor 15 with resistance of $R_0$.

The electrode plate 14 is arranged parallel to and pushed against the roller 10 by a light force to bring it into sliding contact with the rubber layer 12 along the entire length thereof. The electrode plate 14 is electrically connected to the power supply 6 to supply signals corresponding to the current flowing through the resistor 15 to power supply 6.

Figure 12:
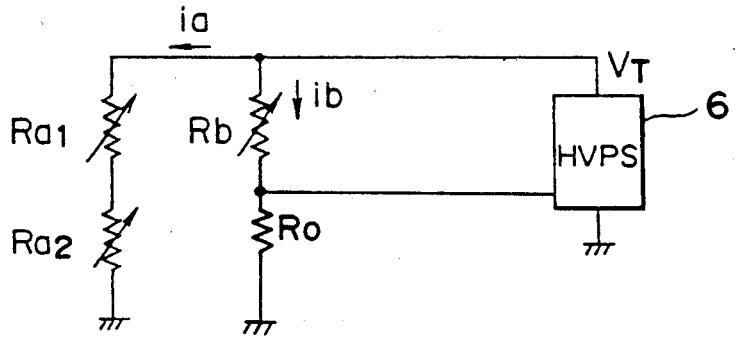
FIG. 12 is an equivalent circuit for the image transfer device of FIG. 10.

The equivalent circuit for the image transfer device of FIG. 10 is illustrated in FIG. 12. In this figure, symbols, $V_T$, $R_{a1}$, $R_{a2}$ and $i_a$, correspond to those used in FIG. 3. However, the shunt resistance $R_b$ is the resistance of the rubber layer 12 of the roller 10, and $i_b$ is a current flowing in the resistor 15 through the roller 10. Since a value of the resistance of the rubber layer 12 serving as the shunt resistance varies with the environmental conditions, $R_b$ is illustrated as being a variable resistance together with $R_{a1}$ and $R_{a2}$. $R_0$ is resistance of the resistor 15.

Figure 13:
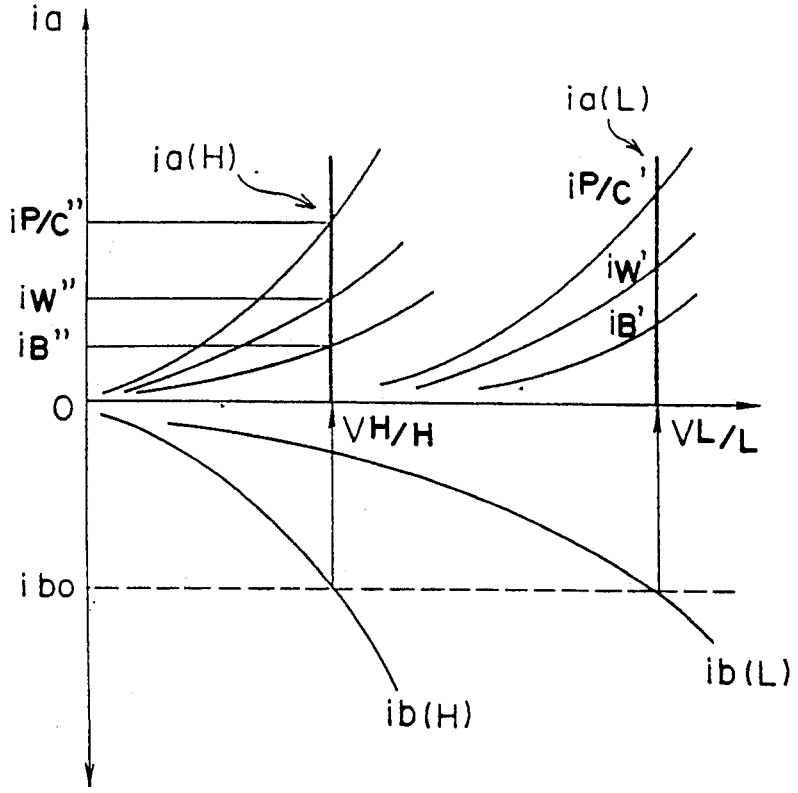
FIG. 13 is a diagram showing voltage versus current characteristics of the image transfer device of FIG. 10.

Operating characteristics of the above image transfer device will be explained below, making reference to FIG. 13 with branched currents $i_a$ and $i_b$ as ordinates and the output voltage of power supply 6 as abscissa. In FIG. 13, a coordinate axis extending upwardly from the origin O is used to express the current $i_a$, while a coordinate axis extending downward from the origin O is used to express the current $i_b$. Also, $i_{b0}$ is a preset current of the high voltage power supply 6.

The fourth quadrant in FIG. 13 shows variation in the current $i_b$ flowing through the roller 10 of the image transfer device for different environmental conditions. A curved line $i_b(L)$ shows an example of a current characteristic for $i_b$ of the image transfer device under L/L conditions, and a curved line $i_b(H)$ shows that of the image transfer device under H/H conditions. Similarly, the first quadrant shows variation in the current $i_a$, flowing through the roller 10 of the image transfer device for different environmental conditions. A curved line $i_a(L)$ shows one example of a current characteristic for $i_a$ of the image transfer device under L/L conditions, and a curved line $i_a(H)$ shows that of the image transfer device under H/H conditions.

From this figure, it will be seen that the current characteristic curve that expresses the relationship between $i_b$ and $V_T$ or between $i_a$ and $V_T$ shifts toward the higher voltage side (right side in the drawing) when the environmental conditions vary from the N/N conditions to the L/L conditions, while the curve shifts toward the lower voltage side (left side in the drawing) when the environmental conditions vary from the N/N conditions to the H/H conditions.

In use, the current $i_b$ flowing through the resistor 15 (actually, a voltage taken across the resistor 15) is detected and fed to the power supply 6 where the detected value of current $i_b$ is compared with a preset current $i_{b0}$ to regulate the output voltage $V_T$ so that the current $i_b$ becomes equal to the preset current $i_{b0}$. For example, if the environmental conditions vary to the L/L conditions, the values of resistance of the rubber layers 4, 12 are increased, so that the characteristic curve for $i_b$ is shifted to the higher voltage side, the curve $i_b(L)$ for example, to maintain the current $i_b$ constant. As a result, the output voltage $V_T$ is increased to $V_{L/L}$ and the currents $i_{P/C}$, $i_W$ and $i_B$ become $i_{P/C}'$, $i_W'$ and $i_B'$, respectively. On the other hand, if the environmental conditions vary to the H/H conditions, the resistances of rubber layers 4, 12 are reduced and thus the characteristic curve for $i_b$ is shifted to the lower voltage side, the curve $i_b(H)$ for example, to maintain the current $i_b$ constant. Thus, the output voltage $V_T$ is decreased to $V_{H/H}$ and the currents $i_{P/C}$, $i_W$ and $i_B$ are changed to $i_{P/C}''$, $i_W''$ and $i_B''$, respectively.

As mentioned above, the characteristic curves for $i_{P/C}$, $i_W$ and $i_B$ shift to the left or right side according to the change of environmental conditions, so that $i_{P/C}'$, $i_W'$ and $i_B'$ under the L/L conditions become equal to the current $i_{P/C}''$, $i_W''$ and $i_B''$ under the H/H conditions. In other words, the values of current $i_{P/C}$, $i_W$ and $i_B$ are maintained constant regardless of the change of environmental conditions, thus making it possible to carry out good transfer of images from the photoconductive drum to the transfer paper throughout the four seasons.

Since the reference roller 10 has the same environmental dependency of resistance as that of the transfer roller 2 and is arranged along the entire length of the photoconductive drum, and since the current $i_b$ used as the input signal to the power supply 6 is a current flowing through the resistance roller 10, the change of environmental conditions surrounding the photoconductive drum 100 is reflected in the output voltage $V_T$ of the power supply 6.

Figure 14:
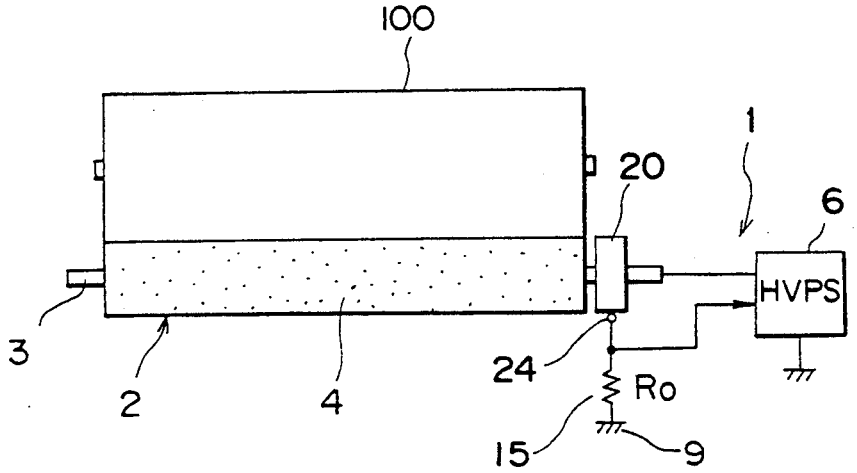
FIG. 14 is a schematic diagram of an image transfer device illustrating still another embodiment of the present invention.
Figure 15:
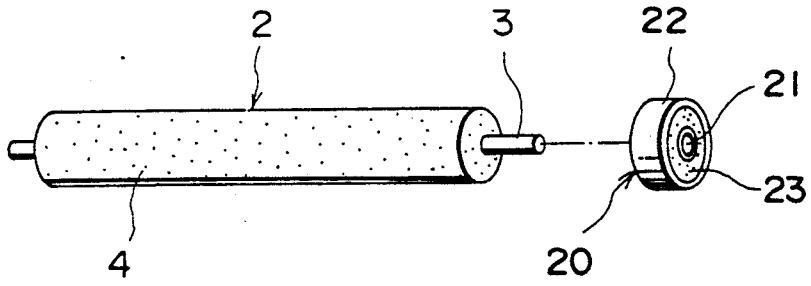
FIG. 15 is an exploded perspective view of a roller assembly used in the image transfer device of FIG. 14.

Referring to FIGS. 14 and 15, there is shown another embodiment of the image transfer device according to the present invention. The image transfer device 1 includes a shunt resistance ring 20 fitted on the shaft 3 of the transfer roller 2, instead of the additional roller 10 shown in FIG. 10.

As illustrated in FIG. 15, the ring 20 comprises a spongelike rubber layer 23 interposed between inner and outer cylindrical electrodes 21 and 22. The rubber layer 23 is made of the same material used for the rubber layer 4 so that it has electric resistance equal to that of the rubber layer 4 of the transfer layer 2. The inner electrode 21 is electrically connected to a high-voltage power supply 6 with the constant-voltage characteristic through core 3, while the outer electrode 22 is connected to an electrical ground 9 through a contacting terminal 24 and a resistor 15. The terminal 24 is so arranged near the one end of the transfer roller 2 that it comes in sliding contact with the outer electrode 22. Further, the outer electrode 22 is connected to the power supply 6 through the terminal 24 to apply signals corresponding to the current flowing through the resistor 15, $i_b$, to the power supply 6 as feedback signals.

The equivalent circuit of the image transfer device of FIG. 14 is also given by FIG. 12. In this case, $R_b$ represents the resistance of the shunt resistance ring 20 and $i_b$ represents a current flowing through the ring 20. Since the resistance of rubber layer 23 of ring 20 varies with the environmental conditions, $R_b$ is illustrated as being variable resistance along with resistance $R_{a1}$ and $R_{a2}$.

The image transfer device 1 of FIG. 14 has the same current-voltage characteristics as those of the image transfer device of FIG. 10 and operates almost exactly like the latter. Thus, the operation of this embodiment can be explained in the same manner as that of the image transfer device of FIG. 10.

Figure 16:
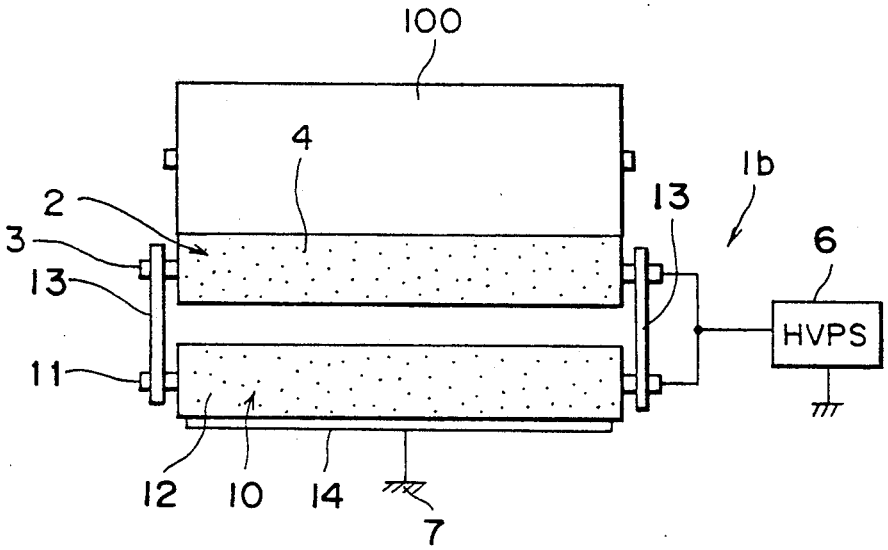
FIG. 16 is a schematic diagram illustrating a modified form of the image transfer device of FIG. 10.

FIG. 16 shows a modified form of the image transfer device shown in FIG. 10. The image transfer device of this embodiment has the same physical construction that the image transfer device of FIG. 10 has, while its electrical circuit differs from that of the latter as the electrode plate 14 is directly connected to the electrical ground 9, the resistor 15 being removed.

Figure 17:
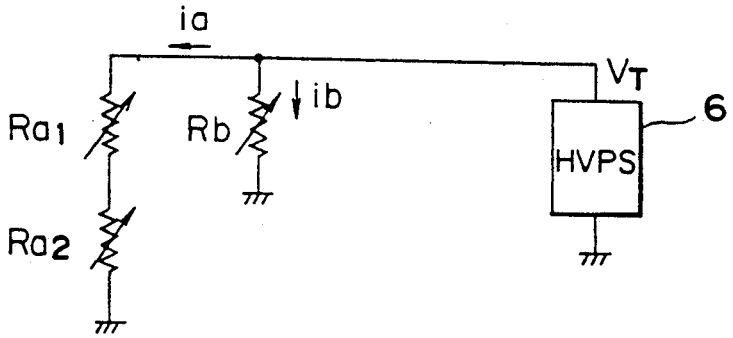
FIG. 17 is an equivalent circuit for the image transfer device of FIG. 16.

Thus, the equivalent circuit for the image transfer device of FIG. 16 is given by FIG. 17. In this figure, all the symbols $V_T$, $R_{a1}$, $R_{a2}$, $R_b$, $i_a$ and $i_b$ correspond to those used in FIG. 12, respectively.

Since this image transfer device 1 has the same current-voltage characteristics as those of the image transfer device of FIG. 10 and operates almost exactly like the latter, there would be no need to explain the operation of this embodiment. It is, however, to be noted that the values of current $i_{P/C}$, $i_W$ and $i_B$ in this embodiment are also maintained constant without use of any feedback circuit, thus making it possible to perform good transfer of the powder images from the photoconductive drum to the transfer paper regardless of the change of the environmental conditions.

Figure 18:
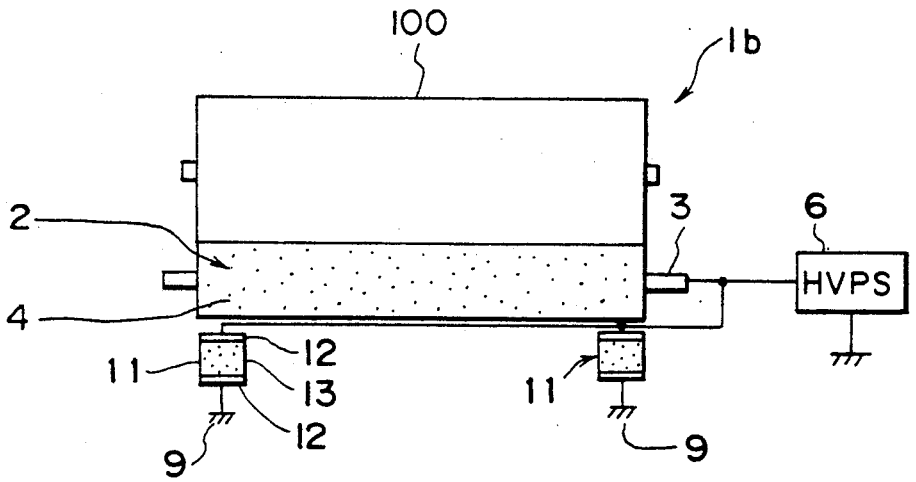
FIG. 18 is a schematic diagram illustrating another modified form of the image transfer device of FIG. 10.

FIG. 18 shows a modified form of an image transfer device according to the present invention. The image transfer device of this embodiment includes an image transfer roller 2 and two reference resisting means or resistance blocks 11 arranged on either side of the transfer roller 2. The transfer roller 2 is identical to that used in the image transfer device of FIG. 8. Each resistance block 11 consists of a resisting material 13 sandwiched between a pair of electrodes 12, of which one is electrically connected to a high-voltage power supply 6a with constant-current characteristics, while the other electrode being connected to the electrical ground 9. The resisting material 13 is composed of the same material as that used for the rubber layer 4 of the transfer roller 2.

Thus, the image transfer device of this embodiment has the same electrical circuit and operating characteristics those the image transfer device of FIG. 16 has. Accordingly, an output voltage of the power supply 6a scarcely changes with change of environmental conditions because of the presence of the resistance blocks 11, and thus currents $i_{P/C}$, $i_w$ and $i_b$ are maintained almost constant. Since the resistance blocks 11 are arranged in pair on either side of the photoconductive drum 100 and electrically connected in parallel with one another, the change of environmental conditions surrounding the photoconductive drum 100 is reflected in the output voltage $V_T$ of the power supply 6a. However, it is unnecessarily required to use the resistance blocks 11 with the same size.

For example, when the present invention is applied to an image-forming device of a one-sided paper-feeding system in which transfer paper is supplied to the drum along a reference line provided on one side of the drum 100, one of the resistance blocks to be arranged on the side of the base line may have a larger size than that of the other side. Also, more than two resistance blocks 11 may be used to constitute the shunt resistance. In such a case, it is preferred to arrange the resistance blocks at regular intervals along the entire length of the transfer roller. Further, it is possible to employ an elongated resistance block 11 with a length substantially equal to that of the transfer roller 2 in order to constitute the shunt resistance. In this case, the elongated resistance block is arranged parallel to the transfer roller 2.

Figure 19:
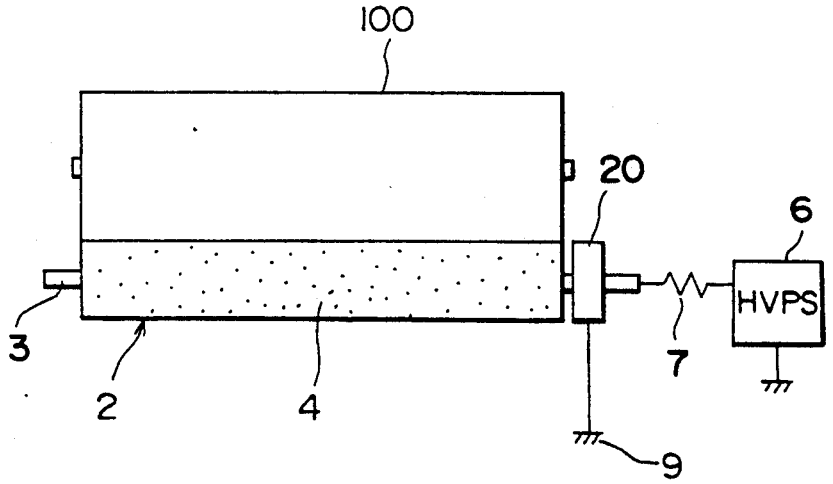
FIG. 19 is a schematic diagram illustrating another modified form of the image transfer device of FIG. 10.

FIG. 19 shows a modified form of the image transfer device shown in FIG. 14. The image transfer device of this embodiment has a physical construction corresponding to that of the image transfer device of FIG. 14, but its electrical circuit is the same as that of the image transfer device of FIG. 1. That is, a control resistor 7 is placed between the shaft 3 and the power supply 6 and the outer electrode of the ring 20 is directly connected to the electrical ground 9. Accordingly, the equivalent circuit of this embodiment is given by FIG. 3.

Since the above image transfer device has the same current-voltage characteristics as those of the image transfer device of FIG. 1 and operates almost exactly like the latter, there would be no need to explain the operation of the image transfer device repeatedly.

Figure 20:
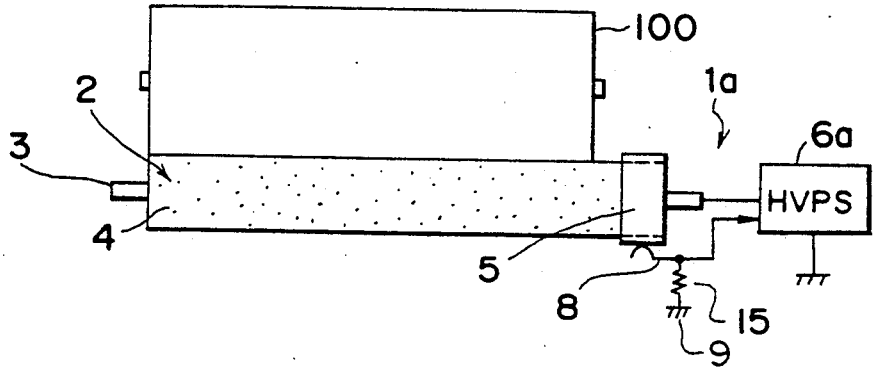
FIG. 20 is a schematic diagram illustrating a modified form of the image transfer device of FIG. 1.
Figure 21:
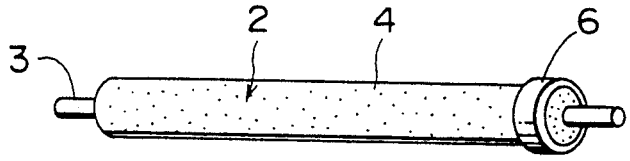
FIG. 21 is a perspective view of an image transfer roller used in the image transfer device of FIG. 21.

FIG. 20 shows a modified form of the image transfer device shown in FIG. 1. In this embodiment, a rubber layer 4 of the transfer roller 2 is uniform in diameter over the entire length thereof and has a length longer than that of a photoconductive drum 100, as shown in FIG. 21. The transfer roller 2 is arranged parallel to a photoconductive drum 100 and brought into contact with the drum 100 under a light pressure. Fitted on a protruding end of the transfer roller 2 is an earthing ring 6 which is electrically connected to one end of a resistor 15 and to a high voltage power supply 6 through an electrode 8. The other end of the resistor 15 is connected to the electrical ground 9.

The equivalent circuit of this image transfer device is given by FIG. 12. The image transfer device of this embodiment has the same current-voltage characteristics as those of the image transfer device of FIG. 10 and operates almost exactly like the latter. Thus, the explanation of operation of the image transfer device of FIG. 10 can be applied to this embodiment.

Figure 22:
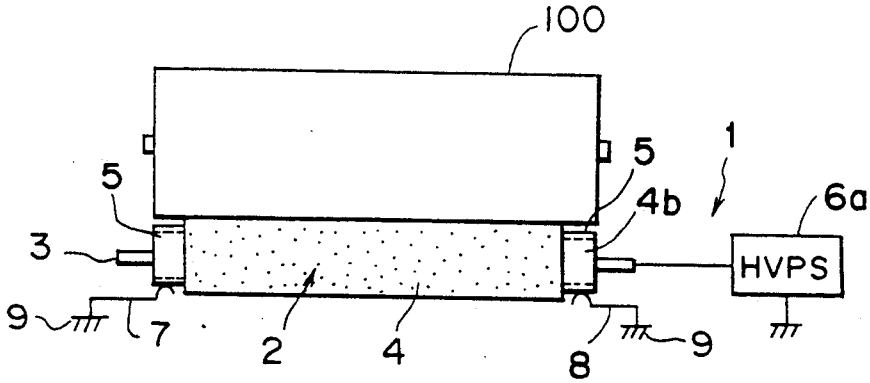
FIG. 22 is a schematic diagram illustrating another modified form of the image transfer device of FIG. 1.
Figure 23:
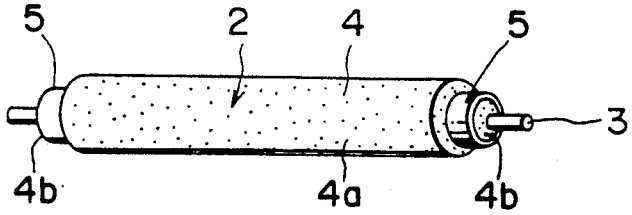
FIG. 23 is a perspective view of an image transfer roller used in the image transfer device of FIG. 22.

Referring now to FIGS. 22 and 23, there is shown another embodiment of an image transfer device according to the present invention. In this embodiment, the image transfer roller 2 comprises a conductive shaft 3 and a foamed spongelike rubber layer 4 formed thereon. The rubber layer 4 is reduced in diameter at both ends thereof to form a small-sized rubber layer 4b on its either side.

Fitted on each small-sized rubber layer 4b is a conductive ring 5 made of aluminum, phosphorus bronze, or other conductive material. Each earthing ring 5 is electrically connected to the electrical ground 9 by an electrode 8 so that the rubber layer 4b between the shaft 4 and the ring 5 constitutes a shunt resisting means with the resistance of $R_b/2$. Each electrode 8 is arranged around the small-sized rubber layer 4b of the transfer roller 2 so that it is in sliding contact with the earthing ring 5. The shaft 3 of the transfer roller 2 is connected to a constant-current power supply 6a.

The equivalent circuit for the image transfer device of this embodiment is also given by FIG. 17. This image transfer device has the same current-voltage characteristics as those of the image transfer device of FIG. 10 and operates almost exactly like the latter. Thus, the operation of the image transfer device of FIG. 10 can be applied to the image transfer device of this embodiment. In this case, a symbol $R_b$ represents a combined value of the resistance of two shunt resisting means connected in parallel with one another, and $i_b$ is a combined value of the current flowing through the shunt resisting means.

In this embodiment, it is sufficient for the transfer roller to have an effective length substantially equal to that of the photoconductive drum 100 since each earthing rings 5 is provided on the small-sized rubber layer 4b extending beyond an effective length 4a of the rubber layer 4 and corresponding to the length of a non-effective area of the drum 100 where no image is developed. The use of such a transfer roller enables to make the image transfer device compact. Further, the output voltage of the high-voltage power supply 6a is not so affected by changes of the environmental conditions as the shunt resisting means is connected in parallel to the series circuit of the roller 2 and the drum 100. In addition, even if there is any variation of the environmental conditions in the axial direction of the roller, its effects on the operating characteristics of the device are averaged by the shunt resisting means provided on both ends of the roller.

In the embodiment of FIG. 22, the image transfer roller 5 is so designed that the rubber layer 4 has an effective length corresponding to that of the photoconductive drum, but the rubber layer 4 may be designed so as to have a length longer than that of the drum to provide a protruding portion on either side. In such a case, each earthing ring 5 may be fitted on each end of the rubber layer having a uniform diameter over its entire length to avoid provision of a small-sized rubber layer.

In the foregoing embodiments, the earthing ring 5 for shunt resistance is formed into a conductive cylindrical member with a metal or a conductive plastic. It is, however, preferred to use a conductive cylindrical member having a plurality of closely-spaced perforations provided therein or a plurality of ribs provided on its inner surface to ensure that the shunt resistance has the environmental dependency of resistance equal to that of the transfer roller.

Figure 24:
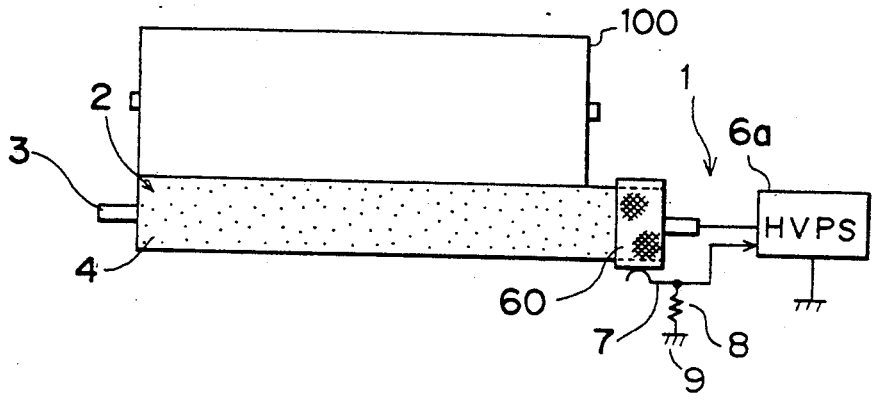
FIG. 24 is a schematic diagram illustrating another modified form of the image transfer device of FIG. 1.
Figure 25:
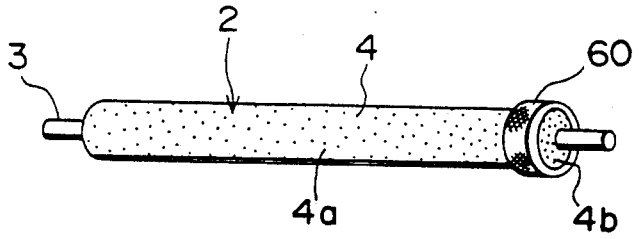
FIG. 25 is a perspective view of an image transfer roller used in the image transfer device of FIG. 24.
Figure 26:
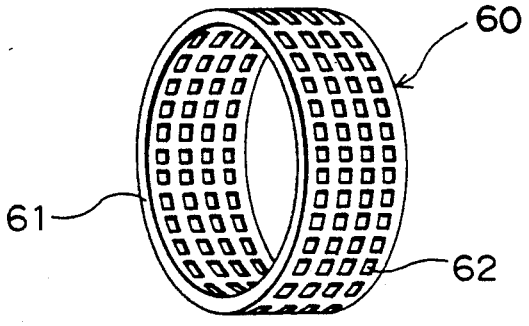
FIG. 26 is a perspective view of an earthing electrode for shunt resistance, used in the image transfer device of FIG. 24.

Referring now to FIG. 24 to FIG. 26, there is shown another embodiment of an image transfer device according to the present invention. This image transfer device 1 has the same physical structure as that of the image transfer device of FIG. 1 except for a shape of the earthing ring.

As best shown in FIG. 26, the earthing ring 60 is composed of a conductive cylindrical member 61 having a plurality of closely-spaced perforations 62 provided therein in a predetermined pattern to allow the rubber layer 4b for shunt resistance to get out in the air. As shown in FIG. 24 and FIG. 25, the perforated ring 60 is fitted on one end of the rubber layer 4 and connected to the power supply 6 through the contact electrode 8 and to the electrical ground 9 through a resistor 15. Also, the shaft 3 of the roller 2 is directly connected to the constant-voltage power supply 6, so that the rubber layer 4b between the ring 60 and the shaft 3 constitutes a shunt resisting means.

Accordingly, the image transfer device of this embodiment has the same electrical circuit that the image transfer device of FIG. 10 has, and its equivalent circuit is given by FIG. 12. Since this image transfer device has the same current-voltage characteristics as those of the image transfer device of FIG. 10 and operates almost exactly like the latter, the operation of the image transfer device of FIG. 10 is applied to this embodiment.

In this case, however, the rubber layer 4b constituting the shunt resistance is exposed to the air as well as the effective rubber layer 4a of the transfer roller 2 to be in contact with the photoconductive drum 100. This ensures that the rubber layer 4b has the environmental dependency of resistance equal to that of the effective rubber layer 4a. Thus, there is no difference in resistance between the effective rubber layer 4a and the shunt resisting means 4b, which in turn makes it possible to control the current flowing through the effective rubber layer 4 more effectively. For this reason, it is possible to maintain the transfer characteristics of the image transfer device constant regardless of changes of the environmental conditions. This is supported by the following examples.

Figure 27:
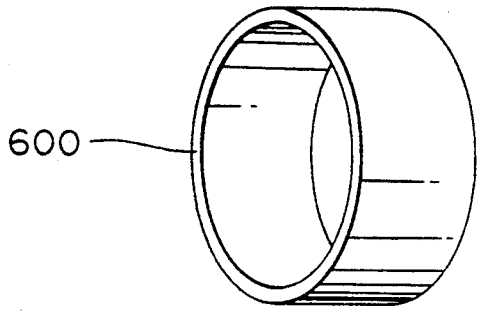
FIG. 27 is a perspective view of a comparative earthing electrode for shunt resistance used in an image transfer device.

A conductive plastic consisting of polypropylene and graphite fibers was formed into a perforated cylindrical member 60 with a structure shown in FIG. 26 and a non-perforated cylindrical member 600 with a structure shown in FIG. 27. Each cylindrical member 60, 600 is fitted on an image transfer roller 2 as an earthing ring 5 to prepare an image transfer device shown in FIG. 1.

The resultant image transfer devices are respectively placed in the same atmosphere and environmental conditions were changed from the N/N conditions (temperature: 25° C., humidity: 60%) to the H/H conditions (temperature: 30° C., humidity: 85%) to determine change of the resistance of the small-sized rubber layer 4b and that of the effective rubber layer 4 being in contact with the photoconductive drum 100 and the transfer paper. Results are shown in FIG. 28.

Figure 28:
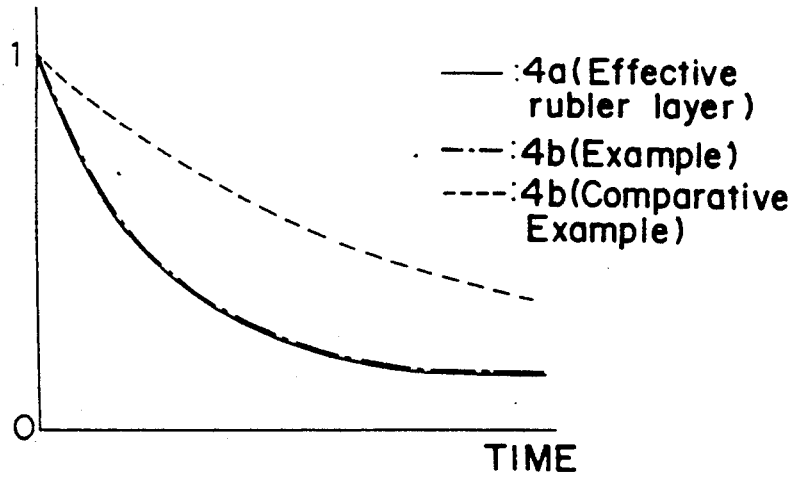
FIG. 28 is a graph showing temperature characteristics of the image transfer roller of the present invention and that of the comparative example.

In FIG. 28, a solid line shows the result for the effective rubber layer 4a, one dotted line shows that for the small-sized rubber layer 4b provided with the perforated earthing ring 60 (example of the present invention), and a broken line shows that for the small-sized rubber layer 4b provided with the non-perforated earthing ring 600 (comparative example).

As will be understood from FIG. 28, the image transfer device according to the present invention possesses no difference in change of resistance between the effective rubber layer 4a and the small-sized rubber layer 4b. In contrast therewith, the image transfer device of the comparative example shows great difference in change of resistance between the small-sized rubber layer 4b and the effective rubber layer 4a, and the rate of change of the resistance of the small-sized rubber layer 4b is considerably higher than that of the effective rubber layer 4.

Figure 29:
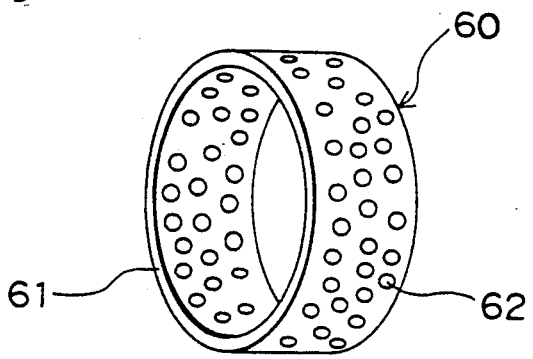
FIG. 29 to FIG. 31 are perspective views each illustrating a modified form an earthing electrode for shunt resistance in the image transfer device according to the present invention.
Figure 30:
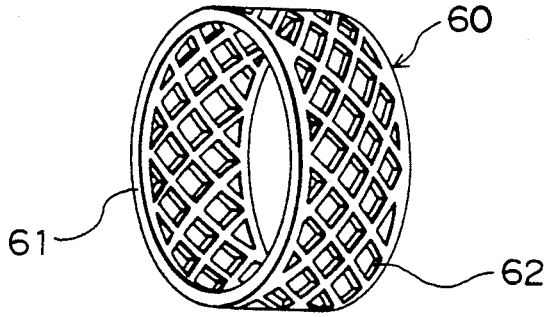

In the embodiment of FIG. 24 to FIG. 26, the perforations 62 of the earthing ring 60 are made square, but they may take any other shapes such as, for example, circular, triangular, rhombic shapes or a combination thereof, as shown in FIG. 29 and FIG. 30.

Further, the earthing ring 5 may take any other configurations, provided that it allows the rubber layer 4b for shunt resistance to get out in the air. For example, the ring may take a configuration as shown in FIG. 31.

Figure 31:
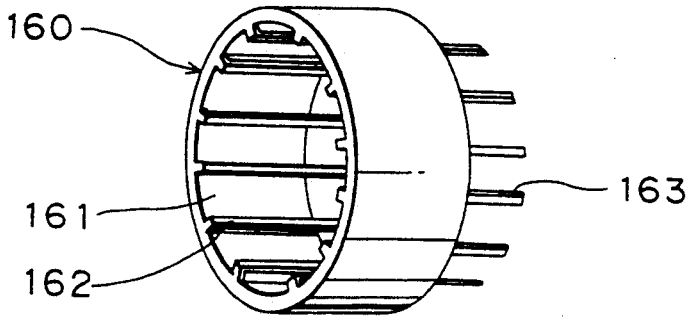

In the embodiment of FIG. 31, a ring 160 serving as an earthing ring is composed of a cylindrical body 161 having a plurality of ribs 162 provided on its inside. The ribs 162 are spaced equally round the circumference of the body 161 and extends beyond one end of the body in the direction of a center axis of the body 161 to form corresponding numbers of projecting portions 163.

The ring 160 may be attached to the rubber roller 4 of the foregoing embodiments by fitting it on the rubber layer 4 or the small-sized rubber layer 4b. In such a case, the ring 160 is so designed that an inscribed circle of the ribs 162 has a diameter slightly smaller than that of the rubber layer 4 or the small-sized rubber layer 4b. Further, the ring 160 may be attached to the rubber layer 4 by inserting the projecting portions 163 into the rubber layer 4. In this case, the earthing ring 160 is so designed that a circumscribed circle of the ribs 162 has a diameter not larger than that of the rubber layer 4.

The present invention can be applied to an image transfer device including an image transfer roller covered with a coating of a reinforcing agent to improve its environmental dependency of characteristics and mechanical properties thereof.

Figure 32:
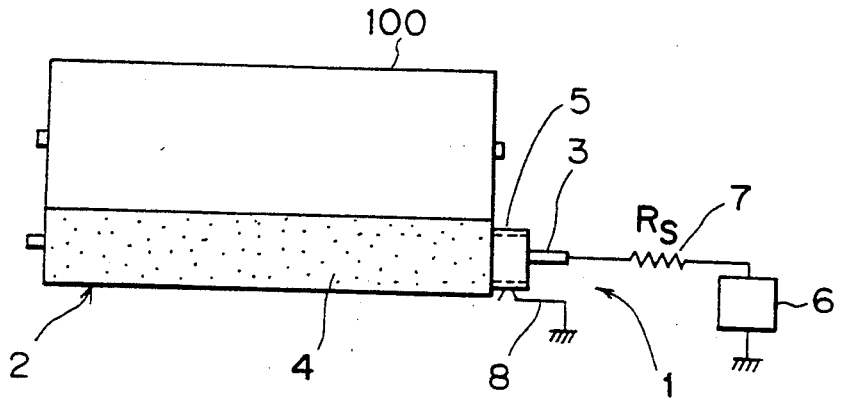
FIG. 32 is a schematic diagram illustrating another modified form of the image transfer device of FIG. 1.

Referring now to FIG. 32, there is shown another embodiment of the image transfer device according to the present invention. The image transfer device has the same physical structure that the image transfer device of FIG. 1 has, except for a surface structure of an image transfer roller 2.

Figure 33:
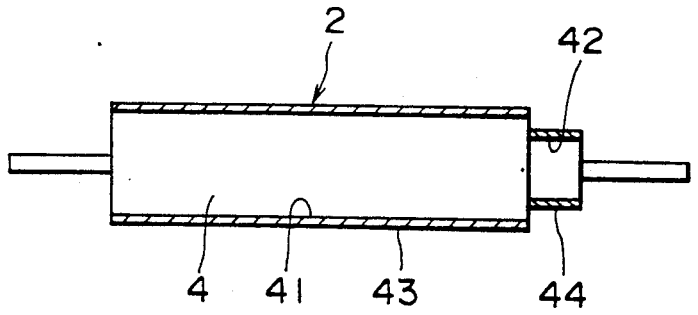
FIG. 33 is a cross section of an image transfer roller used in the image transfer device of FIG. 32.

In this embodiment, as shown in FIG. 33, coatings of a reinforcing agent are formed on a peripheral surface 41 of the effective rubber layer 4 and a peripheral surface of 42 of an small-sized rubber layer 4b by spraying a solution of an reinforcing agent on the surface of the transfer roller 2 and then hardening the same by cure. As a solution of reinforcing agent, there may be used those including a silicone resin dissolved in an organic solvent such as toluene. The coating 44 on the are generally formed so as to have a thickness of about 10 μm, though it may have any desired thickness within the range of 5 to 20 μm.

The image transfer device of this embodiment is electrically assembled so that it has the same electrical circuit that the image transfer device of FIG. 1 has, and thus its equivalent circuit is given by FIG. 3.

Since the image transfer device has the same current-voltage characteristics as those of the image transfer device of FIG. 1 and operates almost exactly like the latter, the explanation for the operation of the image transfer device of FIG. 1 is applied to the image transfer device of this embodiment.

The above coating of the reinforcing agent may be applied to the image transfer rollers used in the image transfer devices of FIG. 1 to FIG. 31 to improve their mechanical properties and environmental dependency of resistance as occasion demands.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An electric charge supplying device for supplying electric charges to a body to be charged, comprising a constant-voltage power supply for producing a predetermined constant voltage, a charge-supplying member connected to said power supply and being in contact with said body to be charged, a first resistance inserted between said power supply and said charge-supplying member, and a second resistance electrically connected in series with said first resistance but in parallel with a circuit of a current flowing from said charge-supplying member to said body to be charged, said second resistance having the same environmental dependency of resistance that said charge-supplying member has.

2. The device according to claim 1 wherein a plurality of said second resistance are arranged along said charge-supplying member.

3. The device according to claim 1 wherein said second resistance extends along said charge-supplying member.

4. The device according to claim 1 wherein said second resistance is provided as an integral part of said charge-supplying member.

5. The device according to claim 1 wherein said second resistance is removably provided on said charge-supplying member.

6. The device according to claim 1 wherein said second resistance is composed of the same material as that of said charge-supplying member.

7. The device according to claim 1 wherein said charge-supplying member comprises a brush arranged so as to be in sliding contact with said body to be charged, and wherein said second resistance comprises a brush having the same structure as that of said charge-supplying member.

8. An image transfer device for transferring image toners, developed on an image carrier, to a sheet, comprising an image carrier comprising a conductive roller coated with an insulating material for carrying image toners;

an image transfer roller arranged in parallel with said carrier and pushed against the carrier so that it comes in contact with said image carrier under pressure to put the sheet therebetween as well as to convey the same;

a constant-voltage power supply for producing a predetermined constant voltage;

a first resistance inserted between said power supply and said image transfer roller; and a second resistance electrically connected in series with said first resistance but in parallel with a circuit of a current flowing from said image transfer roller member to said sheet to be charged, said second resistance having the same environmental dependency that said image transfer roller has.

9. The device according to claim 8 wherein said second resistance is in contact with a periphery of said conductive roller, uncoated with said insulating material, and is grounded by means of said conductive roller.

10. The device according to claim 8 wherein said second resistance includes a conductive ring fitted on said transfer roller.

11. The device according to claim 10 wherein said transfer roller is provided at its one end with a small-sized portion having a diameter smaller than that of the remaining portion, and wherein said second resistance is fitted on said small-sized portion.

12. The device according to claim 8 wherein said second resistance is arranged near either end of said transfer roller and composed of at least one block including the same material used for said transfer roller.

13. The device according to claim 12 wherein said block is arranged on both ends of said transfer roller.

14. The device according to claim 8 wherein said second resistance is arranged on a rotating shaft of said transfer roller.

15. An electric charge supplying device for supplying electric charges to a member to be charged, comprising:

a charge supplying member brought into contact with said member to be charged;

a resistance arranged on one side of said charge-supplying member along a longitudinal axis of the same, said resistance having the same environmental dependency that said charge-supplying member has; and a power supply for supplying an electric energy to said charge-supplying member and said resistance; wherein said device is so controlled as to maintain a current flowing through said resistance or an output current of said power supply constant.

16. The electric charge supplying device according to claim 15 wherein said resistance is formed as an integral part of said charge supplying member.

17. The electric charge supplying device according to claim 16 wherein said charge supplying member is removably arranged in the electric charge supplying device.

18. The electric charge supplying device according to claim 15 wherein said resistance is made of the same material used for constituting said charge supplying member.

19. The electric charge supplying device according to claim 15, further comprising a controlling means for controlling an output voltage of the power supply so as to maintain an amount of a current flowing through said resistance constant, said controlling means being connected to said resistance.

20. An image transfer device for transferring image toners on an image carrier to a transfer sheet, comprising: a transfer roller for holding and conveying a sheet, on which toners are transferred, along with said image carrier, said roller being brought into contact with said image carrier under pressure; a resistance constituted by the same material as that of said transfer roller; a power supply for supplying an electric energy to said transfer roller and said resistance; wherein said device is so controlled as to maintain a current flowing through said resistance or an output current of said power supply constant.

21. The image transfer device according to claim 20 wherein said resistance has the same construction as that of the transfer roller, and is arranged in parallel with said transfer roller.

22. The image transfer device according to claim 20 wherein said resistance includes a conductive ring fitted on one end of said transfer roller.

23. The image transfer device according to claim 22, further comprising an electrode so arranged that it comes in contact with said ring; a means for detecting a value of a current flowing through said electrode; and a means for controlling an output voltage of said power supply so that the detected current is regulated to a predetermined value.

24. The image transfer device according to claim 20 wherein said resistance is provided on a rotating shaft of said transfer roller.

25. The image transfer device according to claim 24 wherein said resistance includes a first cylindrical electrode having an inside diameter corresponding to a diameter of said transfer roller, a second cylindrical electrode having an inside diameter greater than an outside diameter of said first cylindrical electrode, a resisting material sandwiched between an external surface of said first cylindrical electrode and an internal surface of said second cylindrical electrode, said resisting material being the same material used for the transfer roller.

26. The image transfer device according to claim 20 wherein said transfer roller and said resistance are composed of a foamed sponge consisting essentially of a silicone rubber and carbon black dispersed therein.

27. An image transfer device for transferring toner images on an image carrier to a sheet, comprising: a transfer roller for holding and conveying a sheet on which toners are transferred, along with said image carrier, said roller being brought into contact with said image carrier under pressure; a conductive ring fitted on one end of said transfer roller; a power supply for supplying electricity to said transfer roller and said ring; an electrode being in contact with said ring; a means for detecting a value of a current flowing through said ring; and a means for controlling an output voltage of said power supply so that the detected current is regulated to a predetermined value.

28. The image transfer device according to claim 27 wherein said ring is provided on its inside with one or more projections.

29. The image transfer device according to claim 27 wherein said ring is provided with a plurality of perforations passing therethrough.

30. The image transfer device according to claim 27 wherein said ring is formed into a mesh-like shape.

31. The image transfer device according to claim 27 wherein said transfer roller and said ring are coated with the same material.

32. The image transfer device according to claim 31 wherein said transfer roller and said ring are coated with a silicone resin.

33. An image transfer device for transferring toner images on an image carrier to a sheet, comprising:

a transfer roller for holding and conveying a sheet, on which toners are transferred, along with said image carrier, said roller being brought into contact with said image carrier under pressure;

a power supply for supplying electricity to said transfer roller;

a reference resistance comprising a material substantially equal to that of the transfer roller, said reference resistance being electrically connected at its one end to said power supply and at the other end to the electrical ground;

a means for detecting a value of a current flowing through said reference resistance; and a means for controlling an output voltage of said power supply so that the detected current is regulated to a predetermined value.

34. An image transfer device including a transfer roller arranged in parallel to an image carrier so that it comes in light contact with latter; a power supply for supplying electricity to said transfer roller; a shunt resistance connected in parallel with a series circuit including said transfer roller and said image carrier, said shunt resistance having the environmental dependency of resistance substantially equal to that of the transfer roller.

* * * * *

UNITED STATES PATENT AND TRADEMARK OFFICE

CERTIFICATE OF CORRECTION

PATENT NO. : 5,287,152

DATED : February 15, 1994

INVENTOR(S) : Tateki Oka, et al.

It is certified that error appears in the above-indentified patent and that said Letters Patent is hereby corrected as shown below:

On the Title Page, in the left Column, after the filing date, insert:

--[30] Foreign Application Priority Data

| | | | |
|---|---|---|---|
| Dec. 18, 1991 | [JP] | Japan..... | 3-334864 |
| Mar. 4, 1992 | [JP] | Japan..... | 4-46755 |
| Mar. 4, 1992 | [JP] | Japan..... | 4-46756 |
| Mar. 4, 1992 | [JP] | Japan..... | 4-46775 |
| Oct. 16, 1992 | [JP] | Japan..... | 4-278517 |
| Nov. 13, 1992 | [JP] | Japan..... | 4-303626-- |

Signed and Sealed this

Twelfth Day of July, 1994

Bruce Lehman

*Attest:*

BRUCE LEHMAN

*Attesting Officer*

*Commissioner of Patents and Trademarks*